United States Patent [19]

Pipkin

[11] Patent Number: 4,752,780

[45] Date of Patent: Jun. 21, 1988

[54] OPTO-ELECTRONIC SATELLITE ANTENNA POSITION SENSOR

[76] Inventor: Neil L. Pipkin, Rte. 3, Box 75- B, Florence, Miss. 39073

[21] Appl. No.: 576,914

[22] Filed: Feb. 3, 1984

[51] Int. Cl.[4] ..... H01Q 3/00

[52] U.S. Cl. ..... 343/760; 343/894

[58] Field of Search ..... 318/640; 343/760, 765, 343/766, 894; 250/231 SE; 340/347 P

[56] References Cited

U.S. PATENT DOCUMENTS

| | | | |
|---|---|---|---|
| 2,694,804 | 11/1954 | Wagner | 318/640 |
| 3,158,861 | 11/1964 | Iribe . | |
| 3,163,758 | 12/1964 | Treacy . | |
| 3,530,477 | 9/1970 | Jarrett et al. | 343/766 |
| 3,593,030 | 7/1971 | Jawskowsky . | |
| 3,746,842 | 7/1973 | Fowler . | |
| 3,945,015 | 3/1976 | Gueguen . | |
| 4,003,055 | 1/1977 | Eriksson et al. . | |
| 4,077,037 | 2/1978 | Bryden | 343/5 EM |
| 4,109,389 | 8/1978 | Balcom et al. . | |
| 4,154,000 | 5/1979 | Kramer . | |
| 4,190,962 | 3/1980 | Lyman, Jr. . | |
| 4,215,410 | 7/1980 | Weslow et al. . | |
| 4,333,044 | 5/1982 | Blitchington . | |
| 4,449,084 | 5/1984 | Meno | 318/640 |

*Primary Examiner*—William L. Sikes
*Assistant Examiner*—Michael C. Wimer

[57] ABSTRACT

An apparatus for sensing the position of a satellite receiving antenna with respect to a conventional polar mount. A linear encoding strip is fixed to the antenna, and moves rectilinearly between a radiation source and a radiation detector as the position of the antenna changes. A radiation source comprising a plurality of elements and a radiation detector also comprising a plurality of elements are positioned on opposing sides of the linear encoding strip and in registration with one another. A plurality of interstices are defined on the linear encoding strip at predetermined linear positions corresponding to desired positions of the antenna. Each interstice defines at least one aperture. The number of the apertures and the position of the apertures are used to encode each interstice with a position number. When the antenna is positioned so that one of the interstices of the linear encoding strip is positioned between the opposing radiation source and radiation detector, the number and position of the apertures comprising the interstice is sensed by the radiation detector. The sensed position number may be compared with a user-selected code, and the antenna may be moved by the antenna positioning device until the interstice encoded with a desired position number is between the radiation source and the radiation detector. The encoding strip may be programmed by using adhesive decals. The radiation source and the radiation detector may be housed in a weatherproof housing comprising a modified conventional PVC pipe fitting.

13 Claims, 2 Drawing Sheets

12
22
75
74
76
73
86
42
48
52
54
70
78
33
20
22
26
34
48
32
14
24
18
28
31
28A
16
96
17

Fig.2
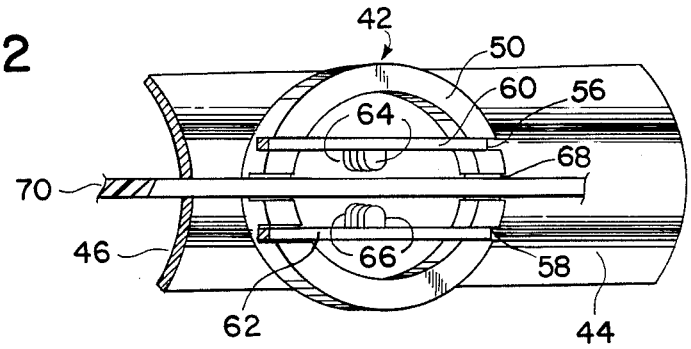
Fig.3
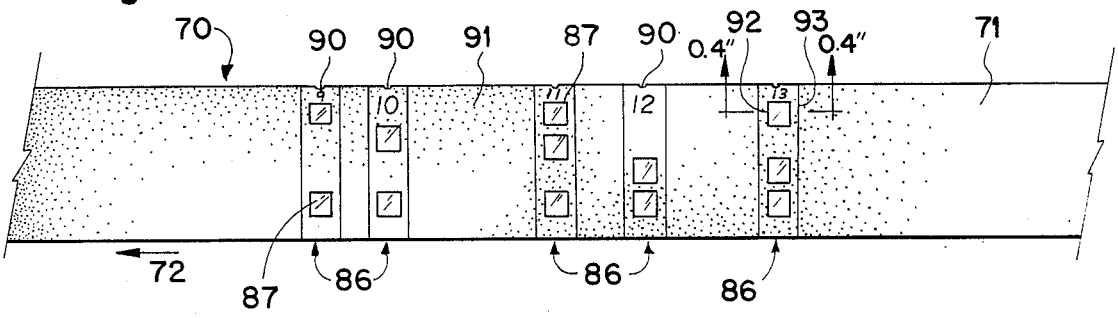
Fig.2A
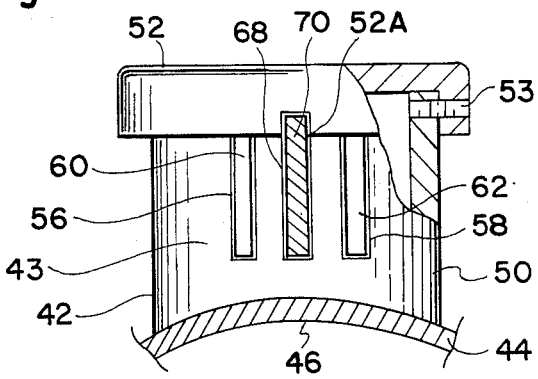
Fig. 4
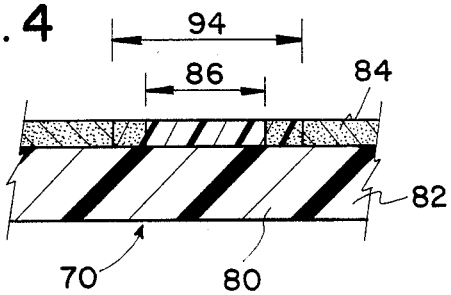
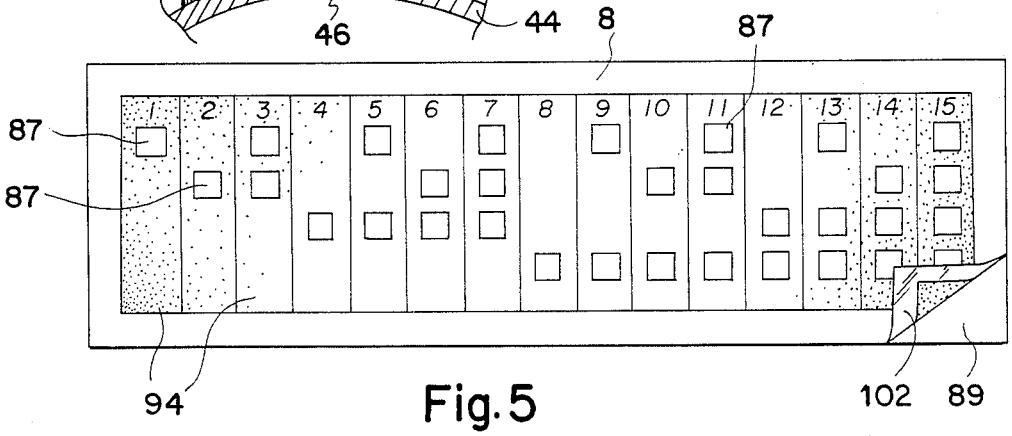
Fig.5

OPTO-ELECTRONIC SATELLITE ANTENNA POSITION SENSOR

FIELD OF THE INVENTION

This invention relates to positional sensing of a directional antenna. More particularly, this invention relates to sensing of the position of a parabolic microwave satellite antenna to aid in automatically aiming the antenna at a selectable one of a plurality of predetermined geosynchronous satellites.

BACKGROUND OF THE INVENTION

The use of earth station parabolic microwave antennas to receive television transmissions directly from satellites in geosynchronous orbit is now commonplace. At present there are many satellites in geosynchronous orbit transmitting signals, and it is often desirable to direct an earth station antenna at different ones of these satellites in order to receive different transmitted material. Antennas may be provided with a positioning device to enable a user to position the antenna as desired. While simple on/off and directional control of the positioning device permits a user to direct the antenna at different satellites while watching a signal strength indicator to maximize received signal strength, it is often difficult and time-consuming to locate a particular desired satellite in the sky. An automatic positioning system for directing the antenna to a selected one of several predetermined positions in the sky, each of which corresponds to the position of a satellite in geosynchronous orbit, would be desirable.

There are several "programmable" automatic satellite positioning systems presently on the market. Most of these available systems use information stored in a volatile random access memory (RAM) during installation (or programmed into the RAM at time of manufacture) to identify antenna position. The actual position of the antenna is then typically monitored by a pulse transducer (e.g. mounted on an actuating motor shaft) whose accumulated output is compared to a stored number of expected pulses in a register or other storage memory. The antenna is repositioned as necessary to match its actual position with a selected desired position as stored in RAM.

One disadvantage of such presently available automatic satellite positioning systems is that the programmed information (or the actual antenna position information) stored in volatile RAM may be accidently lost. Power must be applied to the system at all times in an attempt to prevent such losses. Nevertheless, unavoidable power failures will cause all information stored in RAM to be lost from time-to-time unless some kind of a "backup" battery power source is provided. Line "glitches" (caused by, for instance, power line noise generated during electrical storms or back EMF created by other devices which happen to be fed by the same power line transformer) can also cause information stored in a RAM memory to be lost or changed. Such occurrences can result in unsatisfactory operation at best, requiring reloading of all of the information stored therein. Other disadvantages include the high cost of components and manufacturing, complexity in design, and problems with reliability. A simpler automatic positioning system making use of commonly-available, inexpensive material and which can store non-volatile user programming of the positions of several satellites would be desirable.

One method of sensing the actual position of a movable antenna with respect to a fixed mount is to employ optical sensors. U.S. Pat. No. 4,077,037 to Bryden (issued Feb. 28, 1978) discloses an antenna resolver for indicating the position of a radar antenna. A cylindrical-shaped resolver housing defining a number of longitudinal slots cut through its periphery at predetermined intervals is coupled to a rotatable shaft the position of which determines the position of a directional radar antenna. Light emitting diodes mounted within the resolver housing continuously emit light outward. Phototransistors are mounted outside of the resolver housing, and generate signals when exposed to light produced by the light emitting diodes which shine through the slots in the housing. A register counts the number of on-off alternations in the signals produced by the phototransistors as the resolver housing rotates in order to determine the position of the radar antenna.

Of course, optical monitors for indicating the position of a rotating shaft are relatively well-known. For example, U.S. Pat. No. 3,746,842 to Fowler (issued July 17, 1973) discloses a digital magnetic compass wherein the position of the compass is monitored by optical means. A Grey-coded disk having plural transparent tracks is mounted on the compass shaft. A light source is positioned on one side of the disk, and plural photocells, one for each track of the disk, are mounted on the other side of the disk. The parallel output from the photocells constitutes a binary coded signal which uniquely identifies the rotational position of the disk with respect to a fixed enclosure. The position of the compass shaft may thus be determined by monitoring the output of the photodetectors. U.S. Pat. No. 4,190,962 to Lyman, Jr. (issued Mar. 4, 1980) discloses an improvement on a digital magnetic compass using an encoding cone in place of a disk. The encoded cone is "trimmed" to eliminate non-linearity of the sensor response by darkening sections of it with black lacquer while lightening other sections by fine scratching of the pattern. An optical shaft angle transducer utilizing a rotating control disk having a plurality of radial segments each having relatively opaque and transparent portions with the proportion of the portions changing from segment to segment to provide an output indicating angular position is disclosed in U.S. Pat. No. 4,109,389 to Balcom et al. (issued Aug. 29, 1978).

The position of a satellite receiving antenna may not, however, be adequately described or determined by the position of a single rotatable shaft. U.S. Pat. No. 3,945,015 to Gueguen (issued Mar. 16, 1976) discloses a satellite tracking antenna movably supported on a steering mounting. The antenna may be controlled to rotate independently about an axis of elevation (up and down positioning) and an axis of azimuth (left to right rotation). U.S. Pat. No. 3,158,861 to Iribe (issued Nov. 24, 1964) discloses an apparatus for monitoring the actual position of a radar dish antenna by focusing a spot of light produced by a light source mounted on the radar antenna onto a planar photoelectric sensor. By determining the position of the spot of light on the photoelectric sensor, the elevation and azimuth of the radar antenna may be determined. U.S. Pat. No. 4,003,055 to Eriksson et al. (issued Jan. 11, 1977) discloses improvements to this apparatus.

U.S. Pat. No. 4,215,410 to Weslow et al (issued July 29, 1980) discloses a solar tracker for controlling motors which drive a solar energy utilizing device about its azimuth and altitude axes to track the sun. The controller has a central processor for inputting data corresponding to, among other things, time of day and the latitude and longitude of the device installation. Memories store program data and tables of data corresponding with the declination of the sun. The processor uses the data to calculate the azimuth and altitude angles of the sun and causes signals to be produced which result in motor controllers causing the motors to turn the solar energy utilizing device through azimuth and altitude axes angles corresponding to the calculated angles.

U.S. Pat. No. 4,333,044 to Blitchington (issued June 1, 1982) discloses a method and system for aligning a device with a reference target. A planar art master contains data marks appearing as darkened areas on an otherwise clear plastic film. To locate the art work with respect to the substrate of a printed circuit board, two servomotors accurately position the artwork with respect to the substrate. An image sensor including light-sensing charge-accumulating elements is used to sense the position of the artwork. U.S. Pat. No. 3,593,030 to Jaskowsky (issued July 13, 1971) and U.S. Pat. No. 3,163,758 to Treacy (issued Dec. 29, 1964) both disclose optical sensors for sensing data on a planar card as it moves rectilinearly.

U.S. Pat. No. 4,154,000 to Kramer (issued May 15, 1979) discloses a remote level sensing instrument employing plural light sources and plural light detectors for indicating the horizontal position of an object by optically sensing the position of a bubble in a spirit level.

SUMMARY OF THE INVENTION

The present invention is an apparatus for sensing the position of a satellite receiving antenna with respect to its mount. The antenna is mounted on a conventional polar mount. A positioning device can be actuated to change the position of the antenna with respect to the mount. A linear encoding strip is fixed to the antenna, and moves rectilinearly as the position of the antenna changes. Since the encoding strip moves with the antenna, coded information placed at the precise position of the encoding strip which corresponds to the antenna position of a satellite (the transmissions of which are desired to be received) can be sensed and used by the positioned device to stop the antenna at that particular position.

The exemplary linear encoding strip is opaque except for a plurality of interstices located at predetermined points along its length. A radiation source is positioned on one side of the linear encoding strip, while a radiation detector is positioned in registration with the radiation source on the opposite side of the linear encoding strip. The exemplary radiation source and radiation detector are housed together in a housing fabricated from a conventional PVC pipe fitting. When the rectilinear position of the linear encoding strip with respect to the radiation source and radiation detector is such that one of the interstices is positioned in registration with the radiation source and an associated radiation detector, the radiation detector produces a signal which indicates that the antenna is aimed at one of a predetermined number of satellites in geosynchronous orbit. In this way, the position of the antenna may be selected from one of a number of predetermined fixed positions.

Each of the interstices may also comprise a unique plurality of apertures formed at the same predetermined linear position along the linear encoding strip. Different combinations of apertures are used to encode each interstice with a unique position number (i.e. a digital binary-encoded "word"). The radiation source and the radiation detector each comprise a plurality of elements in registration with one another in this alternate embodiment. When one of the interstices is positioned in registration with the radiation source and the radiation detector, radiation produced by the elements of the radiation source will shine through the apertures onto different ones of the elements of the radiation detector (depending upon the encoded position number of that interstice). The parallel output of the radiation detector is thus the coded position number—one of a plurality of predetermined desired positioned of the antenna. A user may pre-select the code of any one of the predetermined positions. The control apparatus will thereafter automatically determine from the coding of the interstice corresponding to the present position of the antenna the direction in which the antenna must be moved to position it in the newly selected position and then move the antenna accordingly until the newly selected position is reached. The control apparatus stops the antenna when the interstice corresponding to the selected predetermined position is in registration with the radiation source and the radiation detector. The present invention thus provides automatic sensing of the position of a satellite antenna to aim it at a selected one of a predetermined number of different satellites orbiting the earth.

BRIEF DESCRIPTION OF THE DRAWINGS

A more complete understanding of this invention and appreciation of its improvements and advantages may be obtained from the following detailed description and accompanying drawings, of which:

FIG. 2 is a top perspective view of a presently preferred exemplary embodiment of the position sensor shown in FIG. 1;

FIG. 2A is an elevated side view in partial cross-section of the position sensor shown in FIG. 2;

FIG. 3 is a fragmented view in plan of the linear encoding strip shown in FIG. 1;

FIG. 4 is a fragmented side cross-sectional view of the linear encoding strip shown in FIG. 3; and FIG. 5 is a top view of a decal template used to encode the linear encoding strip shown in FIG. 3.

DETAILED DESCRIPTION OF THE PREFERRED EMBODIMENTS

Figure 1:
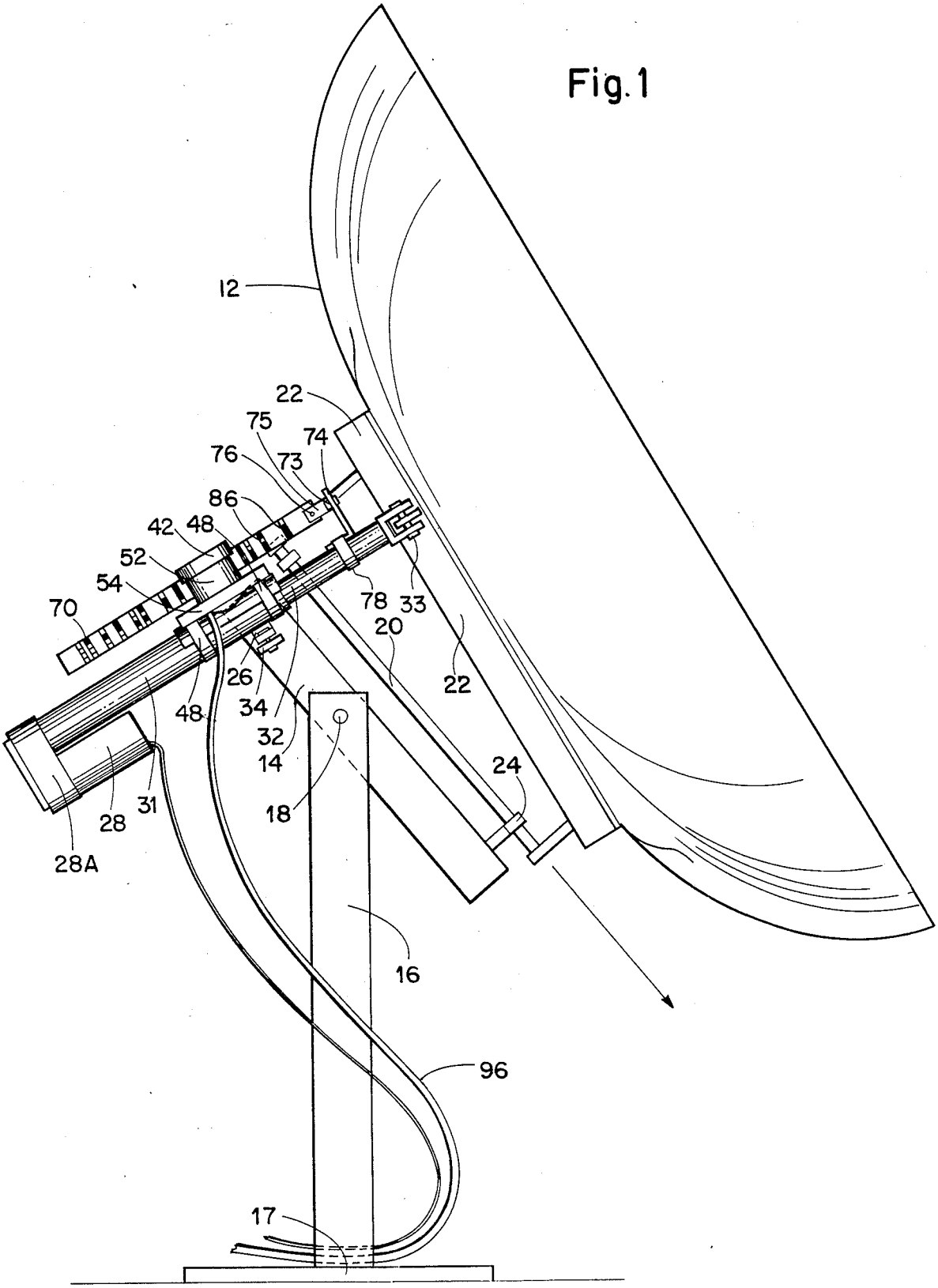
FIG. 1 is a side elevational and schematic view of the presently preferred exemplary embodiment of the present invention.

Referring to FIG. 1, a presently preferred exemplary embodiment of an automatic antenna positioner in accordance with the present invention is shown. A conventional microwave parabolic dish antenna 12 is mounted on a conventional polar antenna mount. The polar antenna mount comprises a vertical azimuth post 16 which is fixedly attached to a surface 17 (such as the ground). A polar axis shaft 14 is journaled to azimuth post 16 by a shaft bushing 18. A bolting bracket 22 is fixed to antenna 12. A tangent drive member 20 is fixed to bolting bracket 22, and is attached to polar axis shaft 14 by adjustable lockdowns 24.

A conventional linear drive system 26 is used to position antenna 12 with respect to azimuth post 16 of the polar antenna mount. Linear drive system 26 includes a motor 28 and reduction drive 28A (which produce a high torque, low angular velocity rotational output) coupled to a screw jack comprising outer tube 31 and inner tube 32 and a worm shaft/screw arrangement (not shown). Screw jack may be swivably mounted to a fixed support 34. Motor 28 may be housed in a common weatherproof housing with linear drive system 26. A linear actuator arm 32 extends from or retracts axially into outer cylinder 31 of the screw jack as the shaft (not shown) of motor 28 rotates in a first or in a second (opposite) direction, respectively. Linear actuator arm 32 is journaled to bolting bracket 22 by axle member 33, and moves antenna 12 with respect to azimuth post 16 as it extends from or retracts into the screw jack. The polar antenna mount controls both the azimuth and the "declination angle" (analogous to elevation) of antenna 12 by the simple axial movement of linear actuator arm 32.

Most satellites of interest for television signal reception transmission orbit the earth in "geosynchronous" orbit. The term "geosynchronous" means that the satellite will appear to always remain fixed (or "geostationary") with respect to an observer located at a fixed position on the surface of the earth. Most satellites of interest orbit the earth in the Clarke Orbit, which is a geosynchronous orbit lying directly above the equator of the earth (i.e., an orbit having latitude equal to 0).

Only the elevation of an antenna located directly on the equator of the earth needs to be controlled (assuming the azimuth to be properly fixed in the equatorial plane) in order to receive transmissions from any one of the geosynchronous satellites orbiting the earth in the Clarke Orbit (of course, transmissions of satellites in this orbit which are located beyond the horizon of the earth with respect to the antenna cannot be received). However, both the azimuth and the elevation of antennas located either north or south of the equator must be controlled in order to accurately track satellites in the Clarke Orbit.

The path in the sky of the Clarke Orbit is fixed with respect to any fixed point on the earth. Likewise, individual satellites in the Clarke Orbit will remain as fixed points on this fixed path with respect to a fixed point on the earth. Therefore, it is not necessary to independently control the azimuth and the elevation of an antenna used only to receive satellites in the Clarke Orbit. Given the known longitude of a desired satellite in the Clarke Orbit and the latitude and longitude of the antenna on the surface of the earth, a simple set of geometric equations provide the desired azimuth and dependent elevation angle settings. With the antenna position fixed, there is a fixed relationship between the azimuth of the antenna and the elevation of the antenna. The elevation is not necessarily linearly related to the azimuth, but rather may be related to the azimuth by a second order equation.

A conventional polar mount replaces the elevation adjustment by a "declination angle" adjustment (the relationship between elevation and the declination angle is determined by the difference in the elevation of the antenna from what the elevation would be in the equatorial plane, and therefore, directly by the position of the antenna on the earth). Polar mounts commonly use an offset adjustment (such as a series of shims, adjustable bars, etc.) which are custom installed at each antenna site to minimize tracking error by approximating a second order relationship betwen the azimuth angle and the declination angle. While polar mounts have limited usefulness due to this tracking error (for instance, because the tracking error increases as the latitude at which the antenna is located increases, polar mounts may not be satisfactorily used above a certain latitude on the earth), they are tending to become more popular, especially since they can be controlled by a single linear drive system (such as linear drive system 26). See Easton, Anthony T. *The Satellite TV Handbook*, 71–83 and Appendix E at 365–368 (Howard W. Sams & Co., Inc. 1983) for a discussion of the conventional polar mount and its operation.

Motor 28 is controlled by a motor controller, which delivers current to appropriate windings of the motor at the appropriate polarities to cause actuator arm 32 to extend or retract. The motor controller, in turn, electrically produces an East signal or a West signal. The East and West signals respectively actuate motor 28 to cause actuator arm 32 to, for instance, extend or retract from the screw jack.

A sensor housing 42 is mounted on outer cylinder 31 of the screw jack (or any other stationary part of the polar antenna mount) by any convenient method. Referring to FIGS. 1, 2 and 2A, sensor housing 42 is fabricated from a conventional 1 and ¼ inch PVC "T" fitting which has had a ½ inch-high annulus 43 cut from a side opening 50 and half of the diameter of the long, through-section 44 cut away. The portion of the long through-section 44 of sensor mount 42 remaining after half of its diameter has been cut away provides a curved mounting surface 46 for mounting to the cylindrical outer casing 31 of the screw jack. While curved mounting surface 46 may be fixed to the screw jack by any convenient method, the presently preferred exemplary embodiment of the present invention includes a pair of conventional stainless steel hose clamps 48 to fix sensor housing 42 to the outer cylinder 31 of the screw jack. One of hose clamps 48 is positioned on either side of the side opening 50 of sensor mount 42, and the hose clamps are then tightened to fix the sensor mount to outer cylinder 31.

Referring more particularly to FIGS. 2 and 2A, two saw kerfs 56 and 58 are cut into side opening 50 of sensor mount 42. Saw kerfs 56 and 58 are cut parallel to one another, and each define chords of approximately equal length across a circular cross-section of side opening 50. Kerfs 56 and 58 are cut axially into side opening 50 so that the chords which they define are of the same length for any given cross-section of the side opening.

Kerfs 56 and 58 are cut into side opening 50 to a depth such that they will accommodate printed circuit boards 60 and 62, respectively. Printed circuit (PC) board 60 is of conventional construction and has mounted upon it (all along a line axial to side opening 50) four infrared light emitting diodes (LEDS) 64. Printed circuit (PC) board 62 (also conventional) has mounted upon it four phototransistors 66 (also on a line axial to side opening 50). Printed circuit boards 60 and 62 are positioned in kerfs 56 and 58, respectively, and LEDS 64 and phototransistors 66 are mounted on printed circuit boards 60 and 62, respectively, such that each one of LEDS 64 is in registration with a different one of phototransistors 66. The lens elements of LEDS 64 and phototransistors 66 face eath other. Once PC boards 60 and 62 have been positioned, respectively, in kerfs 56 and 58, the ½ inch annulus of pipe which was removed from side opening 50 is slipped down over the pipe and the PC boards to hold the bottoms of the PC boards in proper alignment. The emitted infrared radiation of each one of LEDS 64 falls upon a different one of phototransistors 68 mounted directly opposite the LED. Of course, printed circuit boards 60 and 62 can be made to contain any number of LEDS 64 and associated phototransistors 68, depending upon the number of satellite positions which need to be encoded. Four pairs of LEDS 64 and phototransistors 66 permit the positioning of antenna 12 toward one of 15 different satellites, as will be explained shortly.

A third saw kerf 68 is cut into side portion 50 of sensor housing 42 to accommodate a linear encoding strip 70. Encoding strip 70 selectively permits radiation produced by various ones of LEDS 64 to strike associated ones of phototransistors 66, as will be explained shortly. There should be just enough clearance between kerf 68 and encoding strip 70 to permit the encoding strip to freely slide rectilinearly within the kerf with a small amount of clearance (0.02041 ±0.005"). This small amount of clearance will permit sensor housing 42 to operate correctly in any position.

Referring to FIGS. 3 and 4, encoding strip 70 is comprised of a linear strip 80 of rigid, transparent material (such as plexiglass) having a surface 82 upon which is deposited a layer 84 of an opaque material (such as black plastic). Layer 84 should be removable from strip 80, yet should be permanent, durable and thick enough to resist scratching and weathering. In the presently preferred embodiment, linear strip 80 is made of a 1 and ½" wide strip of ⅛ plexiglass, and layer 84 comprises a thin sheet of black latex adhered to surface 82 by an adhesive.

A plurality of interstices 86 are located at predetermined positions along the length of encoding strip 70. The function of interstices 86 is to permit radiation emitted from selected ones of LEDS 64 to strike associated phototransistors 66 when actuating arm 32 (and thus antenna 12) is positioned at one of a number of predetermined positions.

While those skilled in the art can readily devise a number of methods for forming interstices 86 on encoding strip 70, the presently preferred exemplary embodiment utilizes a decal template 88. Referring to FIG. 5, decal template 88 in accordance with the present invention is shown. Decal template 88 comprises a backing 89 (made of, for instance, plastic-coated paper or cardboard) onto which has been adhered a thin layer of adhesive plastic 102. Plastic 102 is divided into fifteen decal strips 94, each one of which bears a unique number (1–15). Each one of decal strips 94 is opaque except for a plurality of apertures 87 (which are transparent). Each of apertures 87 is approximately 0.2 inches square, and is positioned at one of four discrete positions on decal strips 94 (so that each one of the aperatures would be in registration with one of LEDS 64 and its associated phototransistor 66 if decal strip 94 were appropriately positioned between printed circuit boards 60 and 62.

It will be understood by those skilled in the art that a total of 16 unique combinations of apertures 87 exist. While any suitable encoding scheme could be used to uniquely encode each of decal strips 94, the presently preferred embodiment of the present invention uses simple binary coding (so that the one of decal strips 94 labeled "1" is encoded as 0001, the one of decal strips 94 labeled "2" is encoded as 0010, . . . , and the one of decal strips 94 labeled "15" is encoded as 1111). Each one of decal strips 94 defines at least one of apertures 87, for reasons which will become apparent shortly. Decal strips 94 may be peeled away separately from backing 89, and will easily adhere to surface 82 of encoding strip 70.

Referring to FIGS. 3, 4, and 5, the center of each of interstices 86 must first be located before forming the interstices 86 on encoding strip 70. The manner in which the center position of interstices 86 are located for each of the various satellites to be received will be discussed shortly. The center of each of interstices 86 on encoding strip 70 is indicated by a notch 90 cut onto a side edge 91 of the encoding strip. Using a T square, a pencil and a ruler, marks 92 and 93 are drawn across opaque layer 84 on the face 71 of the encoding strip 70 exactly 0.2 inches on each side of each notch 90. Marks 92 and 93, in the exemplary embodiment, should each be *exactly* 0.2 inches from notch 90, exactly parallel to and 0.4 inches apart from each other, and, in the exemplary embodiment, nearly *perfectly* perpendicular to edge 91 of encoding strip 70.

When both of marks 92 and 93 have been drawn, a very sharp knife and a straight edge are used to cut through layer 84. The cut-away area of layer 84 may be left in place until the interstices for all positions have been marked and cut (after marking and cutting, the position between the two lines 92 and 93 for each strip may be marked with an "X" to indicate that this material is to be removed). The material of layer 84 between marks 92 and 93 may be peeled away, leaving only the transparent strip 80.

Each one of the strips formed by peeling away material 84 is covered by one of decal strips 94 from decal template 88. Starting from an end 72 of encoding strip 70, the one of decal strips 94 labeled "1" is lifted from backing material 89 of template 88 and adhered to surface 82 of encoding strip 80 (from which layer 84 was removed). The legend number of each of decal strips 94 should be positioned nearest the edge 91 of encoding strip 70. There must be no crack through which light may shine between the edges of layer 84 remaining on encoding strip 70 and the edges of decal strip 94, and the decal strip must be positioned with its outside edges matching those of layer 84 of the encoding strip. All bubbles should be worked out so that decal 94 lies perfectly flat on surface 82 of encoding strip 70. The above procedure is repeated for the next strip where layer 84 was cut away until a decal strip 94 has been positioned on every one of the areas cut from layer 84. In this way, each one of the notches 90 representing the position of antenna 12 when it is aimed at a desired satellite will correspond to a unique one of decal strips 94. In this way, a plurality of uniquely encoded interstices 86 at predetermined linear positions along encoding strip 70 are formed.

Referring once again to FIGS. 1 and 2, end 72 of encoding strip 70 is fixed to antenna 12 (or to some member which moves together with the antenna). In the presently preferred exemplary embodiment, encoding strip 70 is attached to a spacer 75 by a pivot pin 76 (about which the encoding strip may pivot). Spacer 75 is fixed to an "L"-shaped code strip bracket 74 by a fastener 73 (such as a bolt). An adjustment slot (not shown) in code strip bracket 74 permits adjustment of the position of spacer 75 with respect to the code strip bracket. Code strip bracket 74 is fixed to actuating arm 32 by a conventional hose clamp 78. Encoding strip 70 is disposed in saw kerf 68 of sensor housing 42. A different point along the length of encoding strip 70 will be positioned between LEDS 64 and phototransistors 66 for each different position of actuating arm 32 (and thus for each different position of antenna 12).

PC board 60 and PC board 62 of sensor housing 42 are connected by a cable to the controlling circuitry (cable 96 may connect to terminal strip 54 which in turn is connected to PC boards 60 and 62). The controlling circuitry supplies current to LEDS 64, and accepts as an input the individual outputs of each of phototransistors 66. In addition, the controlling circuitry accepts as an input a binary number encoded by the position of a selector switch. The Selector switch may be a conventional electrical switch (such as a multi-position rotary switch), while the control circuit is a conventional digital logic array. A user selects one of 15 satellites from which transmissions are desired to be received by positioning the selector switch. A Comparator determines whether antenna 12 is aimed at the selected one of the satellites by monitoring the outputs of phototransistors 66.

Provided that antenna 12 is at a position such that one of interstices 86 is in registration with LEDS 64 and phototransistors 66, the phototransistors will generate a parallel four-bit binary number indicating the encoded position number of the one of the predetermined positions in which antenna 12 rests. A comparator determines whether motor 28 must be actuated to rotate clockwise or counterclockwise (to either extend or retract actuating arm 32) by comparing the output of the selector switches with the binary number produced by phototransistors 66. If the binary number produced by phototransistors 66 is less than the number programmed into the selector switches, motor 28 must be actuated to extend actuating arm 32. On the other hand, if the binary number produced by phototransistors 66 is greater than the number programmed into the selector switch, motor 28 must be actuated to retract actuating arm 32. When the binary number output of phototransistors 66 is equal to the number programmed into the selector switches, the comparator turns motor 28 off (since antenna 12 is in the desired position).

It should be noted that when antenna 12 is in a position such that no one of interstices 86 is in registration with LED 64 and phototransistors 66, the phototransistors produce a binary 0 output. Because the comparator will only stop motor 28 when the binary output of phototransistors 66 is equal to the number programmed into selector switches 100, motor 28 will continue to rotate until the proper one of interstices 86 is in registration with LEDS 64 and phototransistors 66. Thus, antenna 12 will always stop such that one of interstices 86 is in registration with LEDS 64 and phototransistors 66 (and antenna 12 is in one of the predetermined positions). Should antenna 12 somehow be moved, (such as for example, by the force of the wind) so that it rests in a position such that no one of interstices 86 is in registration with LEDS 64 and phototransistors 66, the comparator may actuate motor 28 to rotate in either direction until one of interstices 86 is in registration with LEDS 64 and phototransistors 66, and then actuate motor 28 to rotate in the opposite direction if necessary. An end-of-travel limit switch (not shown) may be provided in linear drive system 26 to shut down motor 28 when actuator arm 32 reaches its maximum extended or retracted position.

The accuracy of the antenna positioning device 10 in accordance with the present invention is such that encoding strip 70 usually stops within 1/16 inches of the center of the desired one of interstices 86. Although a "fine tuning" switch (not shown) is provided by which the user can manually actuate motor 28 move antenna 12 slightly to bring in the highest possible received signal strength, such fine tuning is seldom needed if the programming of encoding strip 70 is carefully performed during installation.

A "manual override" switch (not shown) may be provided in the controller to permit a user to control motor 28 directly (rather than automatically) to receive transmission from any satellites the positions of which are not encoded onto encoding strip 70.

To initially program encoding strip 70, antenna 12 must be positioned (by, for example, using the "manual override" function just described) so that transmissions from one of the satellites for which reception is desired are received. A user positions antenna 12 and simultaneously monitors a receiver (not shown) to maximize the received signal strength of the transmissions of a first satellite for which reception is desired. As each satellite is located, the position of antenna 12 is very carefully fine-tuned until, for instance, the best received television picture quality is obtained (it is best to select one of the weaker of the television channels which the desired satellite is transmitting, since the weaker channels require better alignment of antenna 12 for a good quality picture). After the position of antenna 12 is optimized for the selected satellite, motor 28 is powered off. The position of encoding strip 70 is then marked by filing a notch 90 (discussed previously) on edge 91 of the strip (for instance, with a three cornered file) at the center point of sensor housing 42 in exact alignment with LEDS 64 and phototransistors 66. The above process is repeated until all desired satellites have been located and notches 90 have been cut in encoding strip 70 for each one. Decal strips 94 are then positioned as previously described.

To protect sensor housing 42 from the elements, a cap 52 (comprising a standard PVC cap) is positioned over side opening 50 of the sensor housing. Cap 52 is prepared by cutting a center kerf 52A in registration with kerf 68 cut in side opening 50. Cap 52 is installed so that its kerf lines up with kerf 68 so that it will not interfere with the sliding movement of encoding strip 70. Cap 52 may be attached to sensor housing 50 by any convenient method. In the presently preferred exemplary embodiment, screw holes are drilled into opposing sides of cap 52 with a #37 drill bit and tapped for 6-32 screws 53. The sides of side opening 50 are marked, and holes in registration with the holes drilled into side opening 50 are drilled into the side opening for a loose fit with 6-32 screws. Cap 52 is positioned on side opening 50 such that the holes drilled in cap 52 are in registration with the holes drilled in the side opening. 6-32 screws 53 are inserted into the holes and tightened to hold cap 52 in place. Sensor housing 42 should be positioned on cylinder 31 such that cap 52 is directed upward (so that water will be deflected by the cap and any water trapped in sensor housing 42 will run out).

The positioning device in accordance with the present invention is constructed out of easily obtainable standard PVC pipe and other materials, thus facilitating inexpensive construction. Sensor housing 42 is weatherproof without the use of special, expensive materials. Because the encoding strip can easily be programmed using simple tools and decal template 88, a user can encode, install and program the positioning device himself or herself. Power consumption is low because the system need only be turned on to move the antenna to a different position. The positioning system in accordance with the present invention is immune to program losses due to power failures, thus providing a substantial advantage over the programmable automatic satellite positioning systems presently available on the market.

Although only one exemplary embodiment of this invention has been described in detail, those skilled in the art will readily appreciate that there are many ways to modify the disclosed system without materially changing the novel advantages, functions or results. Accordingly, all such modifications are intended to be included within the scope of this invention.

What is claimed is:

1. An apparatus for sensing the position of a directional antenna movable with respect to a fixed mount, said apparatus comprising:

radiation source means for producing radiation;

radiation detecting means, fixed with respect to said source means and optically coupled to said radiation source means, for producing a signal indicating the degree of optical coupling between said radiation source means and said radiation detecting means; and linear encoding strip means, fixed to said antenna and slidably disposed between said radiation source means and said radiation detecting means, for moving rectilinearly with respect to said source and detecting means as said antenna changes position to thereby change the degree of optical coupling between said radiation source means and said radiation detecting means as a function of the position of said antenna.

2. An apparatus as in claim 1 wherein said linear encoding strip means includes means defining at least one interstice disposed at a predetermined linear position on said encoding strip means for changing the degree of optical coupling between said radiation source means and said radiation detecting means when said antenna is positioned at a predetermined desired position.

3. An apparatus as in claim 2 wherein:

said linear encoding strip means includes means defining a substantially opaque surface for optically decoupling said radiation detecting means from said radiation source means; and said interstice-defining means includes means for defining at least one substantially transparent aperture for optically coupling said radiation source means to said radiation detecting means when said antenna is positioned in said predetermined desired position.

4. An apparatus as in claim 3 wherein:

said linear encoding strip means includes a substantially flat, rigid strip of substantially transparent material;

said opaque surface-defining means includes a layer of opaque material disposed on a first surface of said rigid strip; and said aperture-defining means defines at least one aperture in said layer of opaque material.

5. An apparatus as in claim 1 wherein said linear encoding strip means includes means defining a plurality of interstices disposed at predetermined linear positions on said encoding strip means for changing the degree of optical coupling between said radiation source means and said radiation detecting means when said antenna is positioned in one of a plurality of predetermined positions.

6. An apparatus as in claim 5 wherein said interstices-defining means includes encoding means for encoding each of said interstices with a unique position designation.

7. An apparatus as in claim 6 wherein:

said radiation source means includes a plurality of radiation emitting elements; and said radiation detecting means includes a plurality of radiation detecting elements in registration with said radiation emitting elements.

8. An apparatus as in claim 7 wherein:

said linear encoding strip means includes means defining a substantially opaque surface for optically decoupling said radiation detecting means from said radiation source means; and said encoding means includes means for defining, for each interstice, at least one substantially transparent aperture, said position number being encoded by the number and position of said apertures, each of said apertures optically coupling one of said radiation emitting elements to the one of said radiation detecting elements in registration with said one radiation emitting element.

9. An apparatus as in claim 8 further including decoding means, responsive to signals produced by said plurality of radiation detecting elements, for producing a signal indicating said unique encoding of said interstices.

10. An apparatus as in claim 1 further comprising housing means, for positioning said radiation source means and said radiation detecting means, said radiation source means and said radiation detecting means disposed in said housing means, said housing means including means for defining a slot into which said linear encoding strip means is slidably disposed.

11. An apparatus as in claim 10 wherein said housing means includes a T-shaped piece of pipe.

12. An apparatus as in claim 11 wherein said pipe comprises of polyvinyl chloride.

13. An apparatus as in claim 11 wherein a portion of the T-shaped piece of pipe is cut away to define curved mounting surface means for being disposed on an outer surface of a cylinder.

* * * * *